United States Patent [19]

Skaugen

[11] 4,220,501

[45] Sep. 2, 1980

[54] PAPERMAKING MACHINE WITH MEANS FACILITATING STRINGING, AND METHOD

[75] Inventor: Borgeir Skaugen, Beloit, Wis.

[73] Assignee: Beloit Corporation, Beloit, Wis.

[21] Appl. No.: 49,900

[22] Filed: Jun. 19, 1979

[51] Int. Cl.[2] ..... D21F 1/26

[52] U.S. Cl. ..... 162/200; 162/273

[58] Field of Search ..... 142/200, 237

[56] References Cited

U.S. PATENT DOCUMENTS

| | | | |
|---|---|---|---|
| 1,931,062 | 10/1933 | Darby | 162/200 |
| 2,473,100 | 6/1949 | Hornbostel | 162/200 |
| 4,138,316 | 2/1979 | Kessler | 162/200 |

FOREIGN PATENT DOCUMENTS

| | | | |
|---|---|---|---|
| 1923647 | 11/1970 | Fed. Rep. of Germany | 162/273 |

*Primary Examiner*—William F. Smith

*Attorney, Agent, or Firm*—Hill, Van Santen, Steadman, Chiara & Simpson

[57] ABSTRACT

Beam means are provided for facilitating stringing of a forming belt into position with respect to the machine frame. The beam means are supported to be moved transversely from an inactive position generally rearwardly relative to the frame into a position under the front side of the frame for lifting the front side of the frame sufficiently to permit removal of supporting means under the front side of the frame for clearing a lateral passage for the lower run of the forming belt when stringing the belt into the operative position.

18 Claims, 5 Drawing Figures

PAPERMAKING MACHINE WITH MEANS FACILITATING STRINGING, AND METHOD

This invention relates to papermaking machines with means facilitating stringing, and method, and more particularly concerns stringing of fabric forming belts on Fourdrinier type papermaking machines.

In Fourdrinier type papermaking machines, fabric forming belts have a fairly long forming run from the wet end to the dry end of the elongate machine frame. Generally the machine frame will have front and rear side longitudinal frame beams carried on appropriate supports at an elevation which accommodates a return run of the endless forming belt under the frame. Stringing the endless forming belt has always presented a problem.

For the purpose of stringing the forming belt, various expedients have been proposed. For example according to U.S. Pat. No. 1,931,062, the entire table structure is mounted for movement relative to the couch roll for stringing purposes.

U.S. Pat. No. 2,473,100 discloses the use of overhead crane means for lifting one side of the machine frame to permit stringing of the forming belt.

It has also been proposed to cantilever one side of the machine frame to permit stringing access from the other side of the machine frame. Such an arrangement, however, requires massive and expensive cantilever structure.

There has persisted a need for simplification, reduction in original installation cost and improved stringing maneuverability, and the present invention is directed to that end.

An important object of the present invention is to provide new and improved means and method for stringing the forming belt in a papermaking machine, and involving simple, easily maneuverable beam structure.

The invention provides, as an example in a papermaking machine of the Fourdrinier type, including a longitudinal frame elevated above a floor and having a front side and a rear side and carrying forming table, means for supporting an upwardly facing forming run of an endless porous fabric forming belt which has a return run under said frame, and substantially fixed supporting means between said floor and said rear said of said frame, removable means supporting said front said side of frame on said floor, lever beam means for facilitating stringing of said forming belt into operative position with respect to said frame, said lever beam means arranged to extend transversely under said frame after removal from an inactive or storage position, and fulcrum means for supporting said lever beam means under said frame adjacent to said rear side of said frame and extended into a position under and projecting outwardly beyond said front side of said frame for upward movement about said fulcrum for supporting said front side of the frame with sufficient lift to permit removal of said removable supporting means to clear a lateral passage for said lower run of said forming belt when stringing the belt into said operative position.

The invention also provides a method of stringing an endless porous fabric forming belt in a papermaking machine of the Fourdrinier type including a longitudinal frame elevated above a floor and having a front side and a rear side and carrying forming table means for supporting an upwardly facing forming run of said belt and providing for a return run under said frame, said frame being substantially fixedly supported over said floor along said rear side and having removable supporting means between said floor and said front side, moving lever beam means from an inactive or storage position into position under said frame in a transverse orientation wherein said lever beam means extends from a fulcrum rearwardly spaced from said front side and projects outwardly substantially beyond said front side, operating said lever beam means upwardly about said fulcrum into supporting engagement with the front side of said frame with sufficient lift to relieve frame load from said removable supporting means, removing said removable supporting means while said front side is supported by said lever beam means, whereby to clear a lateral passage, stringing said forming belt into operative position relative to said frame and table means and including moving said return run through said lateral passage, replacing said removable supporting means, releasing said lever beam means from supporting relation to said front side of said frame, and returning said lever beam means to said inactive or storage position.

Other objects, features and advantages of the invention will be readily apparent from the following description of a certain representative embodiment thereof, taken in conjunction with the accompanying drawings although variations and modifications may be effected without departing from the spirit and scope of the novel concepts embodied in the disclosure and in which.

Figures 1A, 1B, 2:
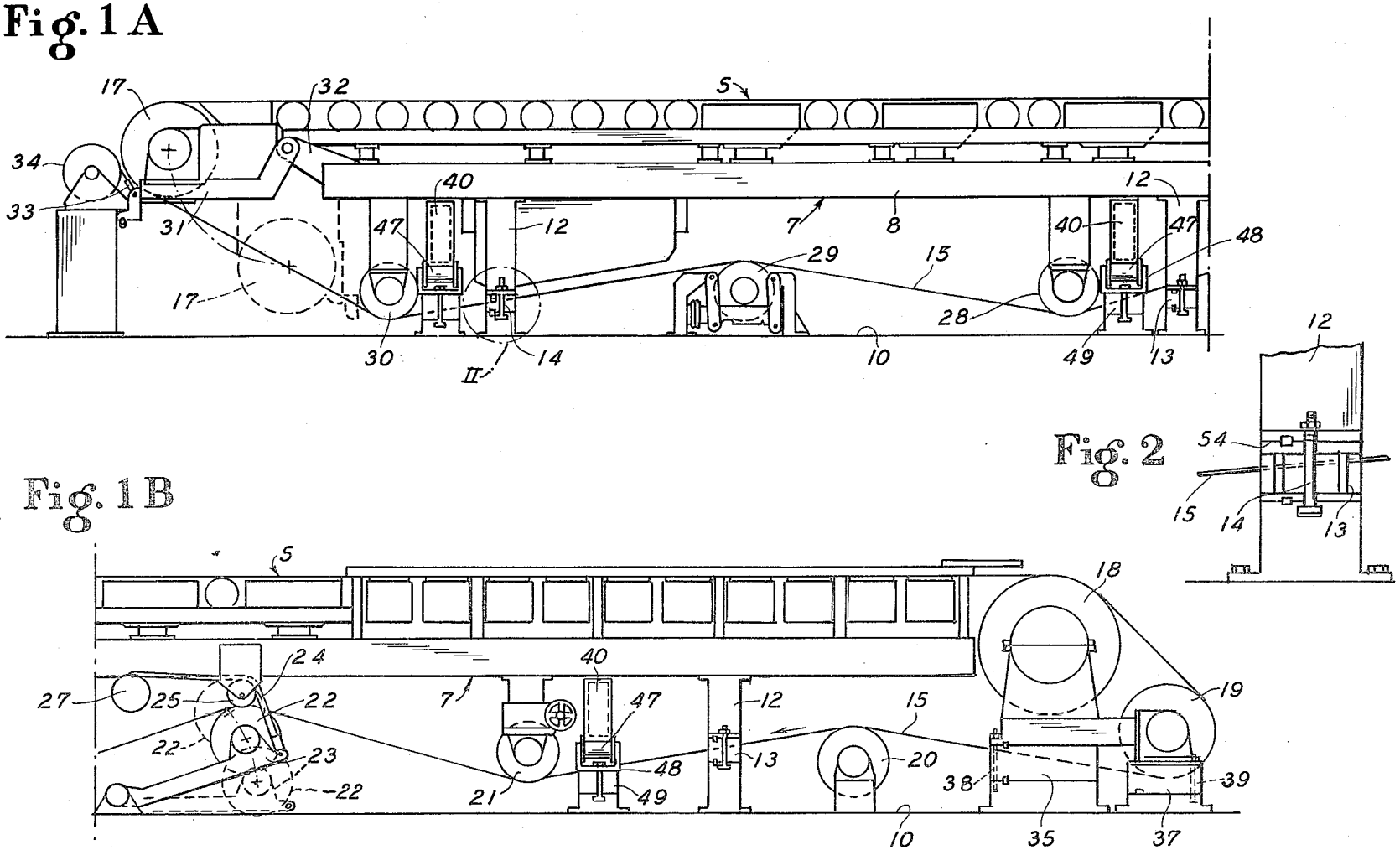
FIGS. 1A and 1B show front side elevations of respectively the wet end and the dry end of a Fourdrinier type papermaking machine embodying the invention.
FIG. 2 is an enlarged fragmentary elevational view taken substantially within the circular dashed outline II of FIG. 1A.
Figure 3:
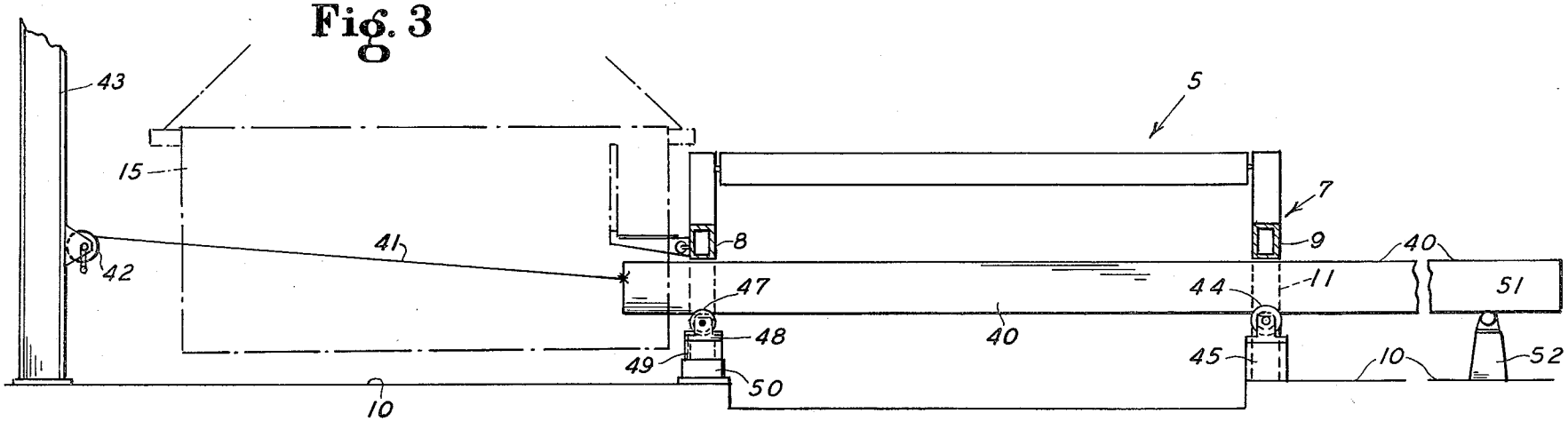
FIG. 3 is a schematic illustration showing the frame lifting beam means of the present invention in one position.

On reference to FIGS. 1A and 1B, a typical Fourdrinier type papermaking machine comprises elongate forming table means 5 carried by an elongate frame 7 having at the front side of the machine a longitudinally extending frame beam 8 and at the rear side of the machine an elongate frame beam 9 (FIG. 3). Along its rear side, the frame 7 is substantially fixedly supported over a machine floor 10 by suitable means such as pillars 11. At its front side, the frame is supported on the floor 10 by means at least in part removal, comprising supporting pillars 12, which may be entirely removable or, as shown, provided with respective removable sections 13 in the form of block, which are adapted to be held in place during operation of the machine by means of releasable bolts 14.

A principal operating part of the papermaking machine comprises a flexible endless fabric forming belt 15, which is threaded longitudinally about the forming table 5 and has an upwardly facing upper forming run on the table 5 and a return run under the frame 7. At the wet end of the table 5, the belt 15 is trained over a breast roll 17. At the opposite or dry end of the table 5, the belt 15 is trained over a couch roll 18 and then over a driving roll 19. In its return run, the belt 15 extends from the driving roll 19 over a guide roll 20 supported on the floor 10, then under a guide roll 21 supported under the frame 7. Thereafter, the belt runs over a tensioning roll 22, which is mounted on an adjustable carriage 23 and controlled by means of a cable or chain 24 trained over a pulley 25 carried by the frame 7 and operated by means of a winch 27 carried by the frame 7. Beyond the take-up roll 22, the return run of the belt travel under a guide roll 28 supported by the frame 7 and then passes over a support roll 29 mounted on the floor 10 from which the return run passes under another guide roll 30 supported by the wet end of the frame 7 and from which the belt continues on over the breast roll 17.

To facilitate stringing of the belt 15, which may be a Fourdrinier wire, the breast roll 17 is mounted on a carriage 31 pivoted to a bracket structure 32 on the frame 7 and normally held in operative position by means of a cable 33 operated by means of a winch 34. When it is desired to thread the belt 15, the breast roll 17 is dropped to the dot dash position shown in FIG. 1A.

Also to facilitate threading of the belt 15, the couch roll 18 and the drive roll 19 are mounted cantilever fashion, as is known practice, whereby the cantilever support is at the rear side of the machine, and the mount for the couch and drive rolls at the front of the machine comprises removable stabilizer blocks 35 and 37 to which the mounts are bolted by means of removable bolts 38 and 39, respectively. When it is desired to thread the belt, the blocks 35 and 37 are removed, thus leaving a gap at the front of the machine under the couch and drive rolls to permit lateral threading maneuver of the belt into position.

Further, during the belt threading maneuver, the front supporting pillar removable blocks 13 are removed to proivde gaps through the front pillars to permit lateral movement of the belt 15 therethrough.

In order to avoid the necessity for cantilever support of the machine frame 7, and the relatively costly structure that would be required for this purpose, if the frame were to be self-supporting when the front pillar blocks 13 are removed, or, alternatively to avoid the need for any overhead pulley means to support or raise the front side of the machine frame for implementing the removal of the front side supporting pillars or parts of those pillars, new and improved simple, easily maneuverable and efficient lever beam means are provided for facilitating stringing of the forming belt 15. To this end, one or more, and in the illustrated instance, three lever beams 40 extend transversely under the frame 7 for the purpose of lifting the front side of the frame 7 sufficiently to permit removal of the removable supporting means, i.e., the blocks 13, to clear a lateral passage for the lower run of the forming belt when stringing the belt into the operative position.

Figure 4:
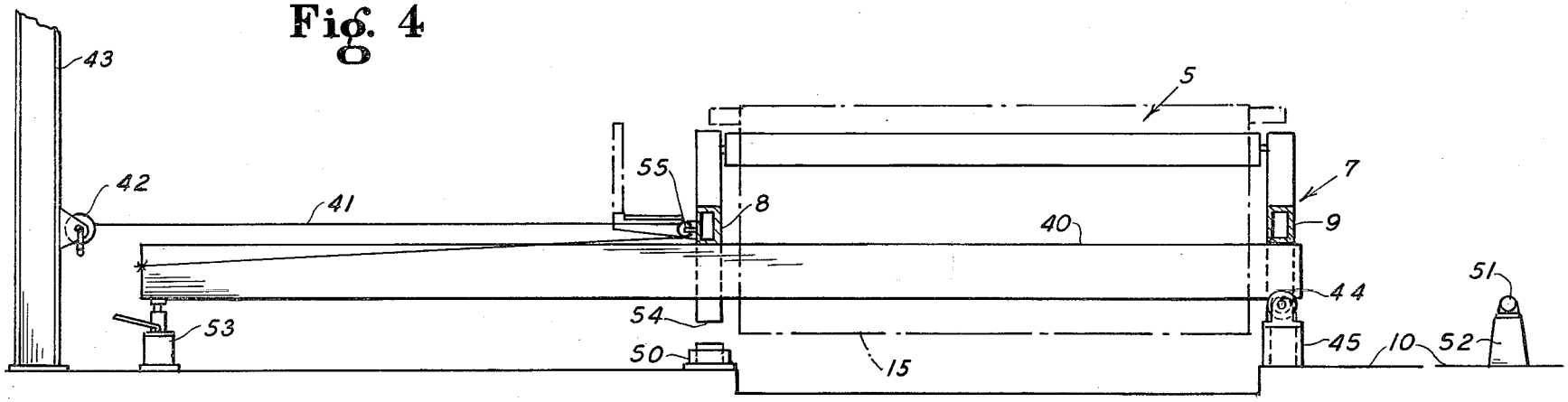
FIG. 4 is a similar schematic illustration showing the beam means in another position.

In a desirable construction, each of the lever beams 40 is of a length to extend from under the rear frame beam 9 to a substantial extent in the aisle along the front side of the machine, substantially as viewed in FIG. 4. For leverage efficiency, the lever beams 40 may be of a length about twice the width of the machine frame 7, although, this may vary, depending upon the size and weight of the machine table and frame. While inactive, the lever beams 40 are adapted to be disposed to extend with their rear end portion rearwardly from the rear side of the machine in a storage area and with the front ends of the beams 40 located in substantially clearance relation with respect to the front side of the machine under the front frame beam 8.

When a forming belt stringing maneuver is to be initiated, the breast roll 17 is dropped, and the clearance gap blocks 35 and 37 under the couch roll and forming roll are removed. The belt 15 is brought into position in the aisle along the front of the machine, as for example by suitable overhead crane means, where the belt is of such a weight as to require overhead support during maneuvering. Where the belt is of lighter weight, so that it can be readily handled by workmen, it may just be manually carried into the stringing position. In any event, with the belt 15 in the stringing position, the lever beams 40 are pulled forwardly. While this may be effected manually, heavier beams may be pulled out as by means of a cable 41 adapted to be operated by means of a winch 42, which may be mounted on an upright 43 of the housing for the machine. To facilitate moving the beam 40, it is desirably supported in stabilized longitudinally running relation on a flanged roller 44 carried by a block 45 mounted on the floor 10 under the rear machine frame beam 9 and by a flanged roller 47 mounted under the front frame beam 8 by means of a bracket 48 supported through a removable block 49 on a base 50 carried by the floor 10. The rollers 44 and 47 support the lever beams 40 in slight clearance relation under the frame beams 8 and 9, in a typical arrangement on the order of $\frac{1}{8}$ inch, whereby to permit free and easy rolling movement of the lever beam between inactive and active positions. For support of the rear end portion of the lever beam 40 in its inactive position, a roller 51 may be mounted on a base 52 at a suitable position rearwardly from the rear roller 44.

After the belt 15 has been maneuvered into stringing position in the front aisle, the winch cable 41 may be attached to the front end of the beam 40 in each instance, and the beam pulled out through the loop of the belt until the front end projects beyond the front side of the belt. Then lifting means comprising a jack 53 is placed in supporting relation under the front end of the beam 40. By means of the jack 53 in each instance, the lever beam 40 is then raised about the fulcrum provided by the rear supporting roller 44, sufficiently to engage firmly with the front frame beam 8 and with adequate lifting pressure to slack off the upper portions of the posts or pillars 12, so that the gap blocks 13 can be readily removed thereby providing belt stringing passage gaps 54 (FIG. 4) through the pillars 12. Further, to facilitate the stringing maneuver, the supporting end guide roller 47, which is not now needed, is removed, desirably with the supporting block 49. At the same time, the take-up roll cable 24 at the front side of the machine is disconnected from the take-up roll carriage 23. A clear passage is then available for movement of the return run of the belt 15 into the operating position of the forming belt 15.

When the stringing has been completed, the outer side supporting rollers 47 for the lever beams 40 are replaced, the removable blocks 13 are replaced in the pillars 12, the tensioning roll cable 24 is replaced, the couch roll and drive roll base blocks 35 and 37 are replaced, and the breast roll 17 returned to its upper operating position. The belt 15 is then properly tensioned and is ready for operation.

After the front lever beam supporting rollers 47 and the gap blocks 13 have been replaced, the jacks 53 are removed or at least slackened off to drop the lever beams 40 onto the rollers 47. The lever beams 40 may then be cleared from the front side aisle by pushing the same rearwardly. Where the beams 40 are of such weight as to require mechanical assistance for moving the same, the winch cable 41 may be trained over a pulley 55 on the side of the frame bar 8 whereby to provide a rearward force on the front end of the associated beam 40 to drive it to the inactive position.

In a preferred construction, the lever beams 40 are of box beam structure which provides the strongest beam geometry for size and length with minimum weight. It may also be noted that each of the machine frame beams 8 and 9 may be of the lightest structure consistent with the normal loads imposed thereon by and through the table 5. The machine frame may be of the simpliest construction consistent with the loads it must carry. Maximum utilization of building space is enhanced. Only low cost, simple equipment suffices for operation of the lever beams, which in and of themselves are low cost members, since they need only have structural strength sufficient to lift and sustain half the load of the machine frame and table, since the remaining half of the load is supported by the supporting pillars or posts 11 at the rear side of the machine.

Stringing of the forming belt is simple and easily effected.

It will be understood that variations and modifications may be effected without departing from the spirit and scope of the novel concepts of this invention.

I claim as my invention:

1. In a papermaking machine including a frame elevated above a floor and having a front side and a rear side and carrying forming means for supporting a facing forming run of an endless porous fabric belt which has a return run about said frame, and substantially fixed supporting means between said floor and said rear side of said frame:

removable means supporting said front said of said frame on said floor;

lever beam means for facilitating stringing of said forming belt into operative position with respect to said frame;

said lever beam means arranged to extend transversely under said frame after removal from an inactive or storage position;

and fulcrum means for supporting said lever beam means under said frame substantially spaced from said front side of said frame and extended into a position under and projecting outwardly beyond said front side of said frame for upward movement about said fulcrum for supporting said front side of the frame with sufficient lift to permit removal of said removable supporting means to clear a lateral passage for said lower run of said forming belt when stringing the belt into said operative position.

2. In a papermaking machine according to claim 1, said removable means comprising posts normally supporting the weight of said table and frame in cooperation with said substantially fixed supporting means.

3. In a papermaking machine according to claim 2, said posts having removable sections adapted to be removed when said front side of said frame is supported by said lever beam means.

4. In a papermaking machine according to claim 1, said lever beam means comprising at least one elongate beam member extending transversely under said frame and supported by antifriction roller means adapting the beam to be freely moved longitudinally thereof under said frame from the inactive or storage position into the position for supporting and lifting said front side of said frame.

5. In a papermaking machine according to claim 4, said roller means comprising a roller providing said fulcrum means.

6. In a papermaking machine according to claim 1, jack means for applying upward thrust to the outwardly projecting part of said lever beam means to effect said upward movement.

7. In a papermaking machine according to claim 1, said beam means when in the outwardly projecting position having a sufficient projecting extent to extend completely through the forming belt already positioned for stringing, whereby the outer end of the lever beam means will be clear of the belt for application of upward thrust to said outer end of the beam means to effect said upward movement.

8. In a papermaking machine according to claim 7, jack means for applying said upward thrust.

9. In a papermaking machine according to claim 1, said lever beam means comprising a plurality of elongate beam members located transversely under said frame at respective spaced points along the length of said frame.

10. A method of stringing an endless porous fabric forming belt in a papermaking machine including a frame elevated above a floor and having a front side and a rear side and carrying forming means for supporting an upwardly facing forming run of said belt and providing for a return run about said frame, said frame being substantially fixedly supported over said floor along said rear side and having removable supporting means between said floor and said front side:

moving lever beam means from an inactive or storage position into position under said frame in a transverse orientation wherein said lever beam means extends from a fulcrum rearwardly spaced from said front side and projects outwardly substantially beyond said front side;

operating said lever beam means upwardly about said fulcrum into supporting engagement with the front side of said frame with sufficient lift to relieve frame load from said removable supporting means;

removing said removable supporting means while said front side is supported by said lever beam means, whereby to clear a lateral passage;

stringing said forming belt into operative position relative to said frame and table means and including moving said return run through said lateral passage;

replacing said removable supporting means;

releasing said lever beam means from supporting relation to said front side of said frame;

and returning said lever beam means to said inactive or storage position.

11. A method according to claim 10, wherein said removable supporting means comprise posts, and removing at least sections of said posts, whereby to clear said lateral passage.

12. A method according to claim 10, wherein said lever beam means comprise at least one elongate beam member located transversely under said frame, and freely moving said beam member longitudinally thereof on antifriction roller means between the inactive or storage position into the lever beam operating position.

13. A method according to claim 12, which comprises utilizing a friction roller of said roller means as said fulcrum.

14. A method according to claim 10, which comprises operating jack means to apply upward thrust to the outwardly projecting part of said lever beam means for operating said lever beam means.

15. A method according to claim 10, which comprises projecting said lever beam means through the forming belt positioned for stringing and extending the outer end of said lever beam means beyond the belt, and applying upward thrust to the outwardly extending end portion of the lever beam means for operating the lever beam means.

16. A method according to claim 15, which comprises applying said upward thrust by operating jack means.

17. A method according to claim 10, wherein said lever beam means comprises a plurality of elongate beam members located transversely under said frame at respective space points along the length of the frame, and operating all of said elongate beam members into supporting engagement with the front side of said frame.

18. A method according to claim 10, which comprises storing said lever beam means in inactive position under said frame means above said return run of the forming belt and in clearance relation to the front side of the machine.

* * * * *